US005187004A

United States Patent [19]

Risseeuw

[11] Patent Number: 5,187,004

[45] Date of Patent: Feb. 16, 1993

[54] SUPPORT FABRIC FOR BULK GOODS

[75] Inventor: Paul Risseeuw, Velp, Netherlands

[73] Assignee: Akzo N.V., Arnhem, Netherlands

[21] Appl. No.: 529,442

[22] Filed: May 29, 1990

[30] Foreign Application Priority Data

May 29, 1989 [DE] Fed. Rep. of Germany ..... 3917358

[51] Int. Cl.[5] ..... D03D 3/00

[52] U.S. Cl. ..... 428/229; 139/420 R; 405/258; 428/225; 428/257; 428/258; 428/259; 428/373

[58] Field of Search ..... 428/229, 225, 257, 258, 428/259, 373; 139/420 R; 405/258

[56] References Cited

U.S. PATENT DOCUMENTS 4,421,439 12/1983 ter Burg et al. ..... 405/258
4,837,387 6/1989 van de Pol ..... 428/229

FOREIGN PATENT DOCUMENTS 0024777 4/1983 European Pat. Off. .
0235853 9/1987 European Pat. Off. .
7930456 3/1980 Fed. Rep. of Germany .

*Primary Examiner*—James J. Bell
*Attorney, Agent, or Firm*—Oliff & Berridge

[57] ABSTRACT

A support fabric for bulk goods which contains synthetic warp yarns interwoven with weft yarns, the warp yarns being formed from straight warp yarns and from binding warp yarns. Each of the straight warp yarns has a higher strength than the binding warp yarns and the construction of the fabric is such that on exposure of the fabric to a tensile force, in the warp direction, the straight warp yarns absorb a significantly higher proportion of the tensile force than the binding warp yarns. According to the invention a sufficiently large proportion, at least, of the straight warp yarns is comprised of polyester and a second sufficiently large proportion, at least, of the straight warp yarns comprises at least one other polymer. The breaking elongation of the straight warp yarns made of polyeser is significantly less than that of the straight warp yarns made of the other polymer and the long-term stability of the straight warp yarns made of the other polymer to highly concentrated acids or alkalis at 35° C. is significantly higher than that of the straight warp yarns made of polyester. Such a support fabric is preferably used for supporting waste material such as domestic waste, industrial waste, sludges and the like on old landfills or similarly soft ground.

14 Claims, No Drawings

SUPPORT FABRIC FOR BULK GOODS

The present invention relates to a support fabric for bulk goods which contains synthetic warp yarns interwoven with weft yarns. The warp yarns are formed from straight warp yarns having a higher strength than the binding warp yarns and the construction being such that on exposure of the fabric to a tensile force in the warp direction, the straight warp yarns absorb a significantly higher proportion of the tensile force than the binding warp yarns.

BACKGROUND OF THE INVENTION

Such a support fabric is known, for example, from EP-B1-0 024 777. In this known support fabric, all the straight warp yarns are formed from polyester or from polyamide, polypropylene, polyethylene or aramids. The reference does not suggest, and virtually excludes, a support fabric which is a composite having a portion of the straight warp yarns made of polyester and another portion of the straight warp yarns made of another polymer as it is directed to a support fabric having great strength for use in construction.

It is true that this known support fabric is highly suitable for the purposes mentioned in European Patent Specification EP-B1-0 024 777, but its suitability for supporting, in particular, chemically aggressive bulk goods still leaves a great deal to be desired. For instance, a support fabric for a waste disposal site is required to last longer than 10 years. This requirement is frequently beyond the limited chemical resistance of polyester. On the other hand, the long term low breaking extension of straight warp yarns attained with polyester in particular result in a high modulus that, combined with minimal creep, are properties that make polyester particularly suitable for support fabrics of the kind in question here.

DESCRIPTION OF THE INVENTION

It is therefore an object of the present invention to provide a support fabric of the kind in question here which is also and in particular suitable for supporting chemically aggressive bulk goods.

This object is achieved by the present invention with a support fabric of the type having straight and binding synthetic warp yarns interwoven with weft yarns when a sufficiently large proportion of, at least, the straight warp yarns comprise polyester and a second sufficiently large proportion, at least, of the straight warp yarns comprises at least one other polymer when the breaking elongation of the straight warp yarns made of polyester is significantly less than that of the straight warp yarns made of at least one other polymer, and when the long-term stability of the straight warp yarns made of another polymer to the destructive effects of highly concentrated chemicals, such as acids or alkalines at 35° C., is significantly higher than that of the straight warp yarns made of polyester.

The support fabric according to the present invention may also contain binding warp yarns and/or weft yarns made of polyester and/or at least one other polymer.

The support fabric according to the present invention offers the advantage that its load bearing capacity is initially, for example during the first 10 years, determined by the straight polyester warp yarns. As the polyester warp yarns gradually degrade, a continuously increasing stress is placed on the straight warp yarns made of another polymer of greater long-term stability. However, by the time a significant portion of the stress is borne by the straight warp yarns made of another polymer, the supported bulk goods or their underlying layers and/or the earth have become sufficiently compacted that the higher extensibility of the straight warp yarns made of another polymer should no longer represent a disadvantage since the support fabric will be little stressed. This is true in particular of underlying muddy ground, which by then will be sufficiently dewatered and thus no longer require as high a load bearing capacity of the support fabric as at the beginning.

It has been found to be particularly advantageous if each of the individual straight warp yarns comprises 30–70% individual polyester fibers and 70–30% fibers of another polymer or if 30–70% of the total straight warp yarns are comprised of polyester and the remaining 70–30% of the straight warp yarns are comprised of another polymer, in particular polyethylene. Preferably, the breaking elongation of the straight warp yarns made of another polymer is only approximately twice as high as that of the polyester warp yarns, which is preferably approximately 10%.

The various straight warp yarns can be arranged alternately, but it is also possible to alternate one or two straight polyester warp yarns and then two straight warp yarns made of another polymer or two or three straight polyester warp yarns and then three straight warp yarns made of another polymer.

It is similarly possible for the warp yarns, in particular the straight warp yarns, to be bicomponent yarns, such as core-sheath yarns. Where core-sheath yarns are used, a core made of polyester and a sheath made of the other polymer are particularly preferred. The composition of the bicomponent yarn, that is a yarn comprising bicomponent fibers or filaments, contains bicomponent fibers which are comprised of 30–70% polyester and 70–30% of another polymer.

If desired, the support fabric according to the present invention may also contain warp yarns and/or weft yarns made of polyamide and/or polypropylene.

A preferred application is the use of the support fabric for supporting waste material such as domestic waste, industrial waste, sludges and the like on old landfills or similarly soft ground.

The straight warp yarns used are particularly preferably twisted yarns, for example multifilament yarns, folded yarns, split yarns and the like or else twisted ribbons, their composition in the support fabric differing from that described in EP-A1-0 235 853.

The support fabric according to the present invention combines properties of high strength coupled with low extensibility and chemical resistance over prolonged periods, i.e. over 20 years or more, and therefore has many applications. In particular, it meets the new, strict and increasingly tough requirements of waste disposal sites.

To avoid repeating the background of the invention and further summaries of related subject matter and fields of the invention, reference is made to the disclosures of U.S. Pat. No. 4,421,439, corresponding to EP-B1-0 024 777 identified above, and U.S. Pat. No. 4,837,387, corresponding to EP-A1-0 235 853, insofar as the disclosures of these publications are relevant here and are not at odds with the teaching disclosed herein, which would be immediately apparent to the person skilled in the art.

An advantageous embodiment of the support fabric has straight warp yarns made of polyester and of polyethylene, each of the straight warp yarns made of polyethylene consisting of 5 to 20 elementary yarns, having a denier of 500 to 2000 dtex and comprising 50 to 250 filaments. In such a support fabric, the yarn just specified preferably accounts for 50 to 90% of the total weight of the support fabric.

In a further advantageous embodiment, however, at least the straight warp yarns can also be made of polyethylene-sheathed polyethylene terephthalate, i.e. core-sheath yarns, or be made from bicomponent yarns formed from polyethylene and polyethylene terephthalate.

Finally, the warp yarns, in particular the straight warp yarns, can also be made of polyvinylidene fluoride (PVDF).

Such a support fabric is suitable for supporting bulk goods that are extremely chemically aggressive and which leak a leachate containing high concentrations of inorganic acids, inorganic alkalis and/or hydrocarbons whereby the polyester yarns are chemically attached over time. In such a case, the chemically inert, or substantially inert, straight warp yarns made from another polymer, in particular polyethylene, take over the stabilizing and separating function between the ground and the bulk goods dumped on the support fabric. This transfer of function is enabled by the compaction of the ground whereby it becomes more load bearing and by the dumped bulk goods becoming consolidated, which lightens or reduces the load on the support fabric over time.

EXAMPLE 1

| | |
|---|---|
| Designation: | Support fabric 300/300-50 |
| Warp yarn type (straight warp yarns): | Diolen 850 PE 67 |
| Polymer (straight warp yarns): | Polyester Polyethylene |
| Warp yarn denier (straight warp yarns): | dtex 1100 dtex 1100<br>f192 × 15Z60 f100 × Z60 |
| Binding warp yarn type: | Enkalon (nylon) cord |
| Binding warp yarn denier: | dtex940f140Z130 |
| Weft yarn type: | Enkalon (nylon) cord |
| Weft yarn denier: | dtex1880 |
| Fabric construction on loom/weave design: | |
| Straight warp yarns/ binding warp yarns: | 2:2 in straight warp special |
| Number of straight warp yarns: | 5 per cm, i.e. 2 × PES + 3 × PE |
| Number of binding warp yarns: | 5 per cm |
| Number of weft yarns: | 5 per cm |
| Fabric weight: | 1600 g/cm |
| Warp yarn contraction: | not determined |
| Binding warp yarn contraction: | 70% |
| Weft yarn contraction: | 3.5% |
| Fabric thickness: | 6.0 mm |
| Hydraulic conductivity under a differential hydrostatic head of 10 cm: | 30 cm/min |
| Strip tensile strength (ultimate tensile strength) in warp direction: | 300 kN/m |
| Strip breaking elongation (ultimate elongation) in warp direction: | 12% respectively 20% |

EXAMPLE 2

| | |
|---|---|
| Designation: | Support fabric 400/200-50 |
| Warp yarn type (straight warp yarns): | Diolen 770 PE 67 |
| Polymer (straight warp yarns): | Polyester Polyethylene |
| Warp yarn denier (straight warp yarns): | dtex 1100 dtex 1100<br>f210 × 18Z60 f100 × 18Z60 |
| Binding warp yarn type: | Enkalon (nylon) cord |
| Binding warp yarn denier: | dtex940f140Z130 |
| Weft yarn type: | Enkalon (nylon) cord |
| Weft yarn denier: | dtex1880 |
| Fabric construction on loom/weave design: | |
| Straight warp yarns/ binding warp yarns: | 2:2 in straight warp special |
| Number of straight warp yarns: | 5 per cm, i.e. 1.67 × PES + 3.33 × PE |
| Number of binding warp yarns: | 5 per cm |
| Number of weft yarns: | 5 per cm |
| Fabric weight: | 1300 g/cm |
| Warp yarn contraction: | 1-2% |
| Binding warp yarn contraction: | 70% |
| Weft yarn contraction: | 3.5% |
| Fabric thickness: | 4.0 mm |
| Hydraulic conductivity under a differential hydrostatic head of 10 cm: | 30 cm/min |
| Strip tensile strength (ultimate tensile strength) in warp direction: | 400 kN/m |
| Strip breaking elongation (ultimate elongation) in warp direction: | 12% respectively 20% |

EXAMPLE 3

| | |
|---|---|
| Designation: | Support fabric 250/150-50 |
| Warp yarn type (straight warp yarns): | Diolen 770 PE 67 |
| Polymer (straight warp yarns): | Polyester Polyethylene |
| Warp yarn denier (straight warp yarns): | dtex 1100 dtex 1100<br>f210 × 12Z60 f100 × 12Z60 |
| Binding warp yarn type: | Enkalon (nylon) cord |
| Binding warp yarn denier: | dtex940f140Z130 |
| Weft yarn type: | Enkalon (nylon) cord |
| Weft yarn denier: | dtex 3760 |
| Fabric construction on loom/weave design: | |
| Straight warp yarns/ binding warp yarns: | 2:2 in straight warp special |
| Number of straight warp yarns: | 5 per cm, i.e. 1.67 × PES + 3.33 × PE |
| Number of binding warp yarns: | 5 per cm |
| Number of weft yarns: | 7 per cm |
| Fabric weight: | 1000 g/cm |
| Warp yarn contraction: | 1-2% |
| Binding warp yarn contraction: | 70% |
| Weft yarn contraction: | 3.5% |
| Fabric thickness: | 2.0 mm |
| Hydraulic conductivity under a differential hydrostatic head of 10 cm: | 30 cm/min |
| Strip tensile strength (ultimate tensile strength) in warp direction: | 250 kN/m |
| Strip breaking elongation (ultimate elongation) in warp direction: | 12% respectively 20% |

What I claim:

1. A support fabric for bulk goods comprising synthetic warp yarns interwoven with weft yarns, said warp yarns being formed from straight warp yarns and from binding warp yarns, each of the straight warp yarns having a higher strength than the binding warp yarns and the construction being such that on exposure of the fabric to a tensile force in the warp direction the straight warp yarns absorb a significantly higher proportion of the tensile force than the binding warp yarns, wherein a sufficiently large proportion of at least the straight warp yarns comprises a polyester and a second sufficiently large proportion of at least the straight warp yarns comprises at least one other polymer, a breaking elongation of the straight warp yarns made of the polyester being significantly less than that of the straight warp yarns made of the other polymer and a long-term stability of the straight warp yarns made of the other polymer to highly concentrated acids or alkalis at 35° C. is significantly higher than that of the straight warp yarns made of the polyester.

2. The support fabric as claimed in claim 1, wherein each of the individual straight warp yarns comprise 30–70% polyester fibers and 70–30% fibers of the other polymer.

3. The support fabric as claimed in claim 1 wherein 30–70% of the total straight warp yarns are comprised solely of polyester and a remaining 70–30% of the straight warp yarns is comprised solely of the other polymer.

4. The support fabric as claimed in claim 1, wherein the breaking elongation of the polyester is approximately 10% and the breaking elongation of the other polymer is approximately 12 to 25%.

5. The support fabric as claimed in claim 1, wherein a straight warp yarn of polyester alternates with two straight warp yarns comprised of the other polymer.

6. The support fabric as claimed in claim 1, wherein two straight warp yarns comprised of polyester alternate with three straight warp yarns made of the other polymer.

7. The support fabric as claimed in claim 1, wherein the other polymer comprises polyethylene.

8. The support fabric as claimed in claim 1, further comprising warp yarns made of polyamide.

9. The support fabric as claimed in claim 1, further comprising warp yarns made of polypropylene.

10. The support fabric as claimed in claim 1, wherein at least the straight warp yarns comprise polyethylene-sheathed polyethylene terephthalate.

11. The support fabric as claimed in claim 1, wherein the other polymer comprises polyvinylidene fluoride (PVDF).

12. The support fabric as claimed in claim 1, wherein the straight warp yarn is comprised of bicomponent fibers, said bicomponent fibers being comprised of 30–70% polyester and 70–30% of the other polymer.

13. The support fabric as claimed in claim 12, wherein the bicomponent fibers are core-sheath fibers with the core comprised of the polyester and the sheath comprised of the other polymer.

14. A method of using a support fabric, comprised of synthetic warp yarns interwoven with weft yarns, said warp yarns being formed from straight warp yarns and from binding warp yarns, each of the straight warp yarns having a higher strength than the binding warp yarns and the construction being such that on exposure of the fabric to a tensile force in the warp direction the straight warp yarns absorb a significantly higher proportion of the tensile force than the binding warp yarns, wherein a sufficiently large proportion of at least the straight warp yarns comprises a polyester and a second sufficiently large proportion of at least the straight warp yarns comprises at least one other polymer, a breaking elongation of the straight warp yarns made of the polyester being significantly less than that of the straight warp yarns made of the other polymer and a long-term stability of the straight warp yarns made of other other polymer to highly concentrated acids of alkalis at 35° C. is significantly higher than that of the straight warp yarns made of the polyester, for supporting waste material such as domestic waste, industrial waste, sludges and the like on old landfills or similarly soft ground.

* * * * *

UNITED STATES PATENT AND TRADEMARK OFFICE

CERTIFICATE OF CORRECTION

PATENT NO. : 5,187,004

DATED : February 16, 1993

INVENTOR(S) : Paul RISSEEUW

It is certified that error appears in the above-identified patent and that said Letters Patent is hereby corrected as shown below:

On the Title page item [56]
add the following Foreign Patent Documents:

| | | |
|---|---|---|
| 2134938A | 8/1924 | United Kingdom |
| 0018335 | 10/1980 | European Pat. Off. |

Column 6, line 37, change "other" (first occurrence) to --the--.

Signed and Sealed this

Ninth Day of November, 1993

*Attest:*

*Attesting Officer*

BRUCE LEHMAN

*Commissioner of Patents and Trademarks*